US009802787B2

(12) United States Patent
Rekieta et al.

(10) Patent No.: US 9,802,787 B2
(45) Date of Patent: Oct. 31, 2017

(54) METHOD OF PROVIDING A CLUTCH FOR A SPOOL

(71) Applicants: Christopher David Rekieta, Inola, OK (US); Gary Donald Thompson, Broken Arrow, OK (US); Michael Leroy Spence, Tulsa, OK (US); Behton Frederick Baugh, Houston, TX (US)

(72) Inventors: Christopher David Rekieta, Inola, OK (US); Gary Donald Thompson, Broken Arrow, OK (US); Michael Leroy Spence, Tulsa, OK (US); Behton Frederick Baugh, Houston, TX (US)

(73) Assignee: Reel Power Licensing Corp., Oklahoma City, OK (US)

( * ) Notice: Subject to any disclaimer, the term of this patent is extended or adjusted under 35 U.S.C. 154(b) by 419 days.

(21) Appl. No.: 14/033,066

(22) Filed: Sep. 20, 2013

(65) Prior Publication Data

US 2015/0083843 A1 Mar. 26, 2015

(51) Int. Cl.
*B65H 75/44* (2006.01)
*B65H 75/38* (2006.01)

(52) U.S. Cl.
CPC ..... *B65H 75/4481* (2013.01); *B65H 75/38* (2013.01); *B65H 2403/72* (2013.01); *B65H 2701/33* (2013.01)

(58) Field of Classification Search
CPC ..... A62B 1/10; A62B 35/0093; G11B 15/50; B66D 5/04; B65H 75/4481; B65H 75/38; B65H 2403/72; B65H 2701/33
USPC ..... 242/355, 394, 394.1
See application file for complete search history.

(56) References Cited

U.S. PATENT DOCUMENTS 3,811,244 A * 5/1974 Killen ..... B65H 67/048 242/470
3,883,119 A * 5/1975 Hansson ..... B66D 1/58 188/134
3,997,093 A * 12/1976 Aizawa ..... B65H 20/20 226/11
4,029,187 A * 6/1977 Davis ..... F16D 43/18 192/105 A
4,449,317 A * 5/1984 Brodribb ..... A01K 89/017 192/15
4,513,772 A * 4/1985 Fisher ..... B65H 75/4407 137/355.22
4,854,192 A * 8/1989 Churchill ..... F16H 61/0295 475/256

(Continued)

*Primary Examiner* — Emmanuel M Marcelo
*Assistant Examiner* — Michael Gallion
(74) *Attorney, Agent, or Firm* — Phillips Murrah PC; Martin G. Ozinga

(57) ABSTRACT

The method of mechanically controlling the rotation of a spool comprising a clutch providing a first position in which a first motive force is applied to the spool through the clutch, providing a second position in which a second motive force is applied to the spool through the clutch, providing third position intermediate to the first position and the second position in which both the first motive force and the second motive forces are applied to the spool through the clutch, such that there during the movement between the first position, the third position, and the second position there is no time at which at least one of the first motive force or the second motive force is not applied to the spool.

7 Claims, 8 Drawing Sheets

(56) References Cited

U.S. PATENT DOCUMENTS 4,917,328 A * 4/1990 Kobayashi ..... G11B 15/22 242/355
5,127,631 A * 7/1992 Flaig ..... B66D 1/54 182/239
5,287,950 A * 2/1994 Feathers ..... A62B 35/0093 188/187
5,342,000 A * 8/1994 Berges ..... B65H 59/00 242/155 M
5,490,020 A * 2/1996 Albrecht ..... G11B 15/50 360/96.3
5,669,567 A * 9/1997 Chiu ..... G11B 15/50 242/355
5,701,972 A * 12/1997 Bloder ..... A62B 1/14 182/234
6,045,076 A * 4/2000 Daniels ..... A01K 89/01555 188/268
6,234,417 B1 * 5/2001 Sauder ..... B65H 75/4442 242/381
6,581,867 B2 * 6/2003 Seo ..... G11B 15/50 242/355
7,422,542 B2 * 9/2008 Freitag ..... B66D 1/485 192/147
7,780,146 B2 * 8/2010 Casebolt ..... A62B 1/10 182/235
2002/0005451 A1 * 1/2002 Valverde ..... B63B 35/816 242/390.2
2003/0052208 A1 * 3/2003 Seo ..... G11B 15/50 242/355
2004/0262437 A1 * 12/2004 Hiraguchi ..... G11B 15/32 242/338.1
2005/0133774 A1 * 6/2005 Long ..... B66D 5/20 254/365
2007/0221898 A1 * 9/2007 Giacomini ..... B66D 1/08 254/323
2008/0061276 A1 * 3/2008 Averill ..... B66D 1/22 254/323
2008/0157042 A1 * 7/2008 Jacobson ..... B66B 9/00 254/270
2008/0185469 A1 * 8/2008 Hsieh ..... E06B 9/70 242/268
2009/0223744 A1 * 9/2009 Dowie ..... E04G 21/3261 182/234
2010/0065799 A1 * 3/2010 Zhou ..... B66D 1/22 254/344
2010/0181145 A1 * 7/2010 Hobson ..... A62B 1/10 182/234
2011/0073435 A1 * 3/2011 Hanussek ..... F16D 43/18 192/17 D
2011/0192929 A1 * 8/2011 Hiraguchi ..... G11B 23/107 242/348
2011/0215285 A1 * 9/2011 Akhavein ..... B66D 3/006 254/344
2014/0217341 A1 * 8/2014 Nam ..... B66D 1/14 254/317
2015/0041740 A1 * 2/2015 Codd ..... B66D 1/08 254/267

* cited by examiner

METHOD OF PROVIDING A CLUTCH FOR A SPOOL

TECHNICAL FIELD

This invention relates to the method of providing a clutch for a spool which allows for two motive forces to be applied through the clutch to the spool, but has no loss of control between the two positions providing the motive forces.

BACKGROUND OF THE INVENTION

Hoses are frequently handled off the side of offshore vessels for the purpose of supplying the offshore vessel with supplies through what are called loading stations. These supplies can simply be liquids such as potable water, oil, diesel fuel, or any of a number of other liquids. Additionally dry powers are handled thru hoses, such as cement, sand, and drilling mud components. Characteristically, when a dry power is to be transported by a loading station, the power is mixed with compressed air as a carrying mechanism, much as tubes are frequently used to carry deposits at a drive-in bank. The primary difference is that the bank deposit is in a specific carrier, whereas the dry powder is simply blown to its destination as a loose powder.

These hoses typically range from 3" to 6" in diameter and will usually float. They can be lowered from the side of a first vessel or a dock and can be floated or pulled to a second vessel or dock.

On an installation there will frequently be several loading stations with individual hoses which are specifically assigned for a specific service such as diesel fuel or potable water. Each of these will characteristically have a motor attached so that the hose can be lowered down to the water and retrieved back after the task is done. The provision of individual motors with the associated controls is a significant expense when planning for several loading stations, as well as the accommodations of multiple motors consumes extra deck space. Deck space on a large offshore drilling rig is some of the most expensive "real estate" in the world.

In spite of the cost associated with the present products as well as the real estate consumed by the multiplicity of motors, improvements to this problem have not been solutions to make this type system more compact by allowing the reuse of a single drive motor, but not having a neutral position on the clutching mechanism.

BRIEF SUMMARY OF THE INVENTION

The object of this invention is to provide a method of providing a clutch which will allow the use of a single motor with a multiplicity of loading stations.

A second object of this invention is to provide a clutch which will allow any of several loading stations to be powered by a single motor.

A third objective of this invention is to provide a clutch which prevents the accidental uncoiling of the loading station hose when it is not being powered.

Another objective of this invention is to provide a clutch which provides no time of disengagement of the clutch providing an opportunity of accidentally losing the hose.

DETAILED DESCRIPTION OF THE INVENTION

Figure 1:
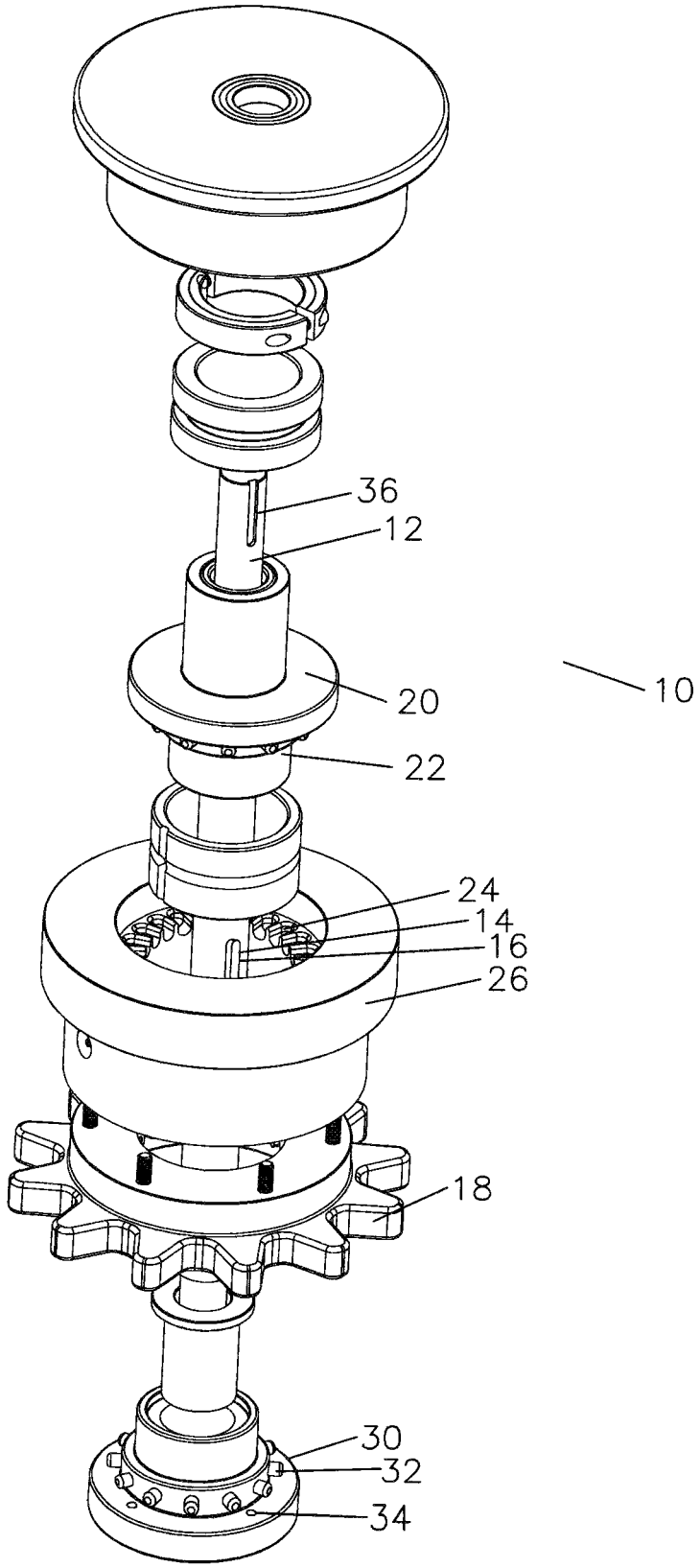
FIG. 1 is a perspective view of a clutch of this invention with the parts spread out.

Referring now to FIG. 1, a perspective view of a clutch 10 of this invention is shown with main shaft 12 with slot 14 and key 16 being available for taking power away through sprocket 18 to drive the spool (not shown).

First body 20 has an internal groove (not shown) to engage key 16 to receive rotational power from main shaft 12 and a multiplicity of pins 22 which will engage slots 24 in roller body 26 as a first clutch position to drive the spool. Alternate mechanisms for the pairing of the multiplicity of pins 22 and the slots 24 can be the engaging of an external gear with an internal gear or the engagement of an external spline with an internal spline.

Second body 30 has a multiplicity of pins 32, but has no internal slot to engage main shaft 12. Rather than receiving rotational power from the main shaft 12, second body 30 has a bolt circle at 34 which is used to rotationally fix the second body 30 to act as a brake. Keyway 36 is characteristic of a key on each end of all shafts which allow them to be connected to each other by couplings which are well known in the art.

Figure 2:
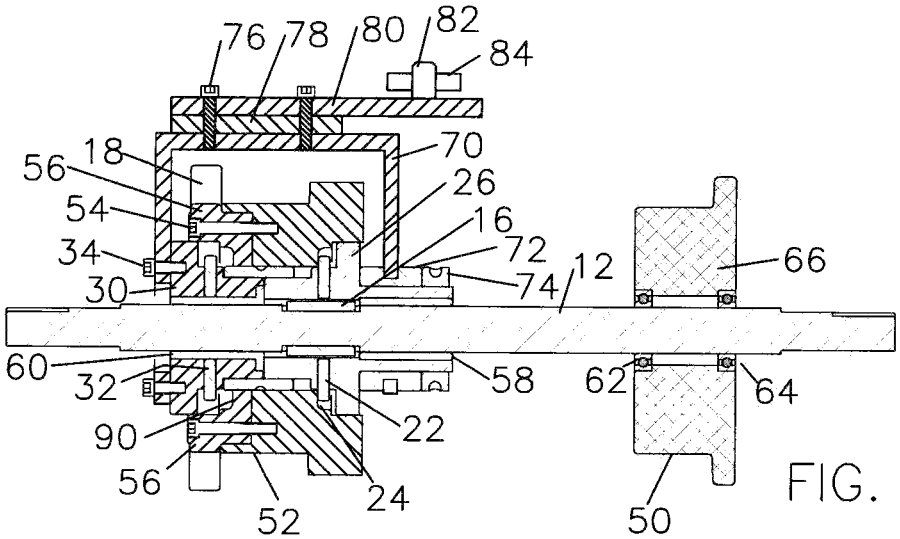
FIG. 2 is a half section of a clutch of this invention in the spool in a driving position.

Referring now to FIG. 2, the components of FIG. 1 are shown assembled and shifted to a first position which delivers rotary power from the main shaft to the sprocket 18 and then to the spool. As will be seen roller surfaces 50 and 52 will be utilized to support a spool and a gear tooth profile on the spool will engage the tooth profile on sprocket 18. Pins 22 are shown engaged with slots 24 such that power from main shaft 12 is delivered through key 16 to roller body 26, through bolts 54 to sprocket body 56 and to the sprocket 18. Bearings 58 and 60 are provided on the clutch and bearings 62 and 64 are provided on roller 66 which has roller surface 50.

Bracket 70 is shown bolted to second body 30 using bolts 34 and engages grooved sleeve 72 which is retained in place by split collar 74. Bolts 76 attach restraint plate 78 and shifting plate 80 to bracket 70. As will be seen, restraint plate 78 acts as a brake by preventing the rotation of second body 30. Pin 82 is engaged by handle 84 to shift the bracket 70 back and forth between the clutch positions.

Figure 3:
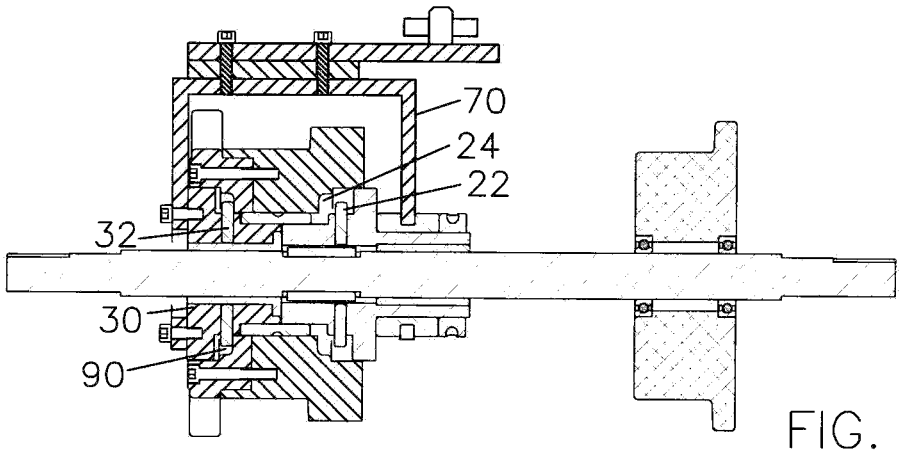
FIG. 3 is a half section of a clutch of this invention in the spool in a braking position.

Referring now to FIG. 3, bracket 70 and all attached parts are shifted to the right to a second position to disengage pins 22 from slots 24 and to engage pins 32 in slots 90. As slots 90 are in second body 30 which is prevented from rotating by attachment to fixture 70 and therefore to restraint plate 78, the spool is prevented from turning. It is effectively a braking position.

Figure 4:
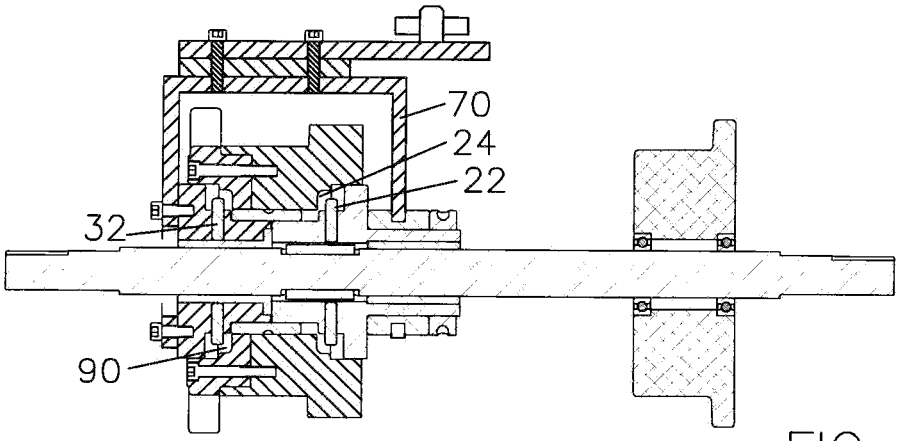
FIG. 4 is a half section of a clutch of this invention in the spool in an intermediate position engaging both the driving shaft and the braking means position.

Referring now to FIG. 4, bracket 70 is moved to a third position intermediate to the first and second positions. In conventional clutching systems this would mean that the clutch would be momentarily disengaged, and this is not usually a problem. However in the present circumstance where the weight of a hose will be suspended from the spool, as the clutch is manually moved from the first position to the second position, the hose can drop. If the clutch parts begin spinning quickly, it may be difficult or impossible to engage the clutch in either of the positions and the hose will be lost.

In this system, the pins 22 and slots 24 remain engaged until after the pins 32 and slots 90 are engaged, so that control is maintained at all times. This may mean in some circumstances that the shaft must be rotated some to allow the pins and slots to line up and make the shift, but safety is always maintained.

Figure 5:
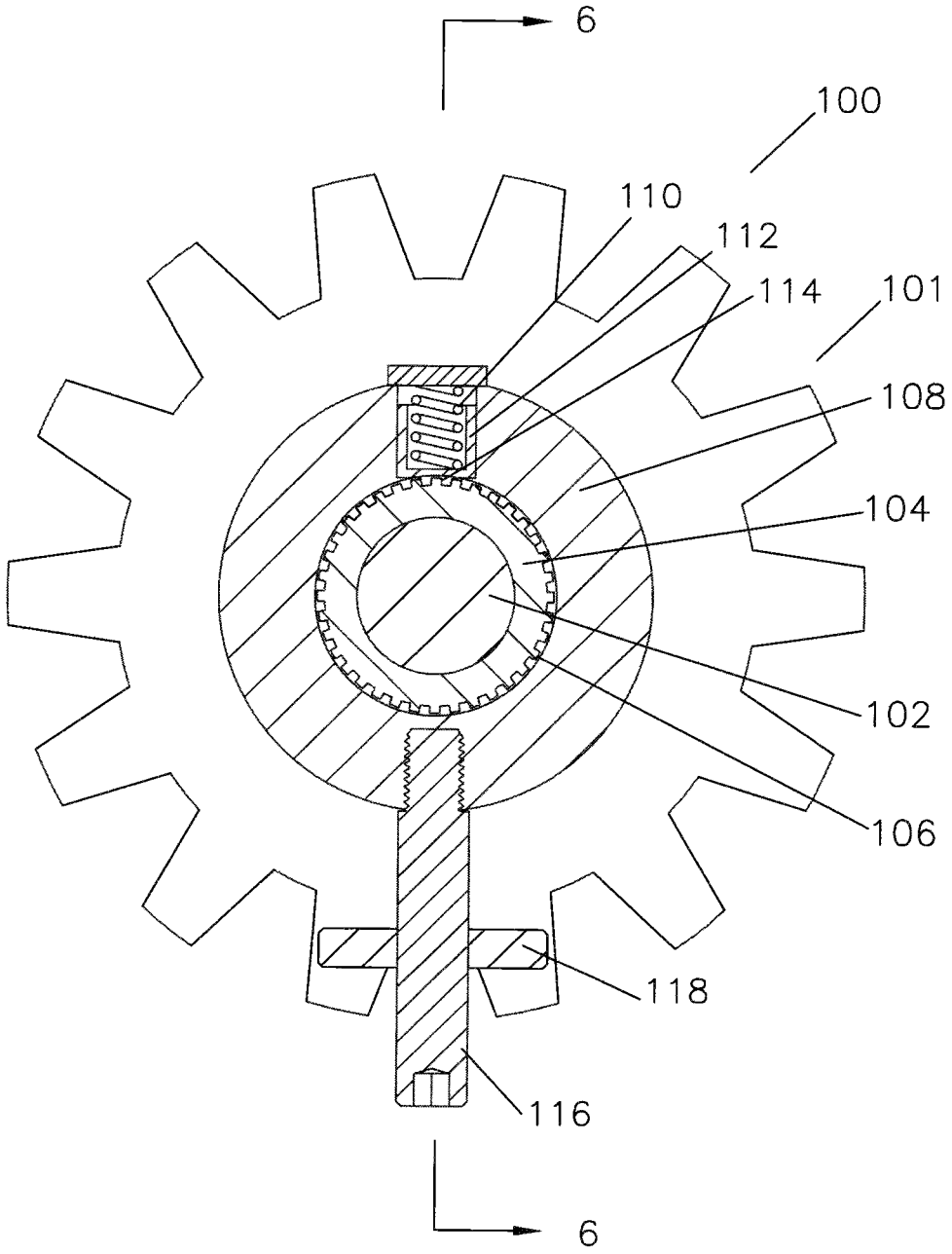
FIG. 5 is a half section thru a clutch of an alternative design.

Referring now to FIG. 5, a view of an alternate design clutch 100 is shown in half section having a sprocket profile 101, an inner main shaft 102 which is surrounded by an output shaft 104 having a spline or tooth profile 106. First body 108 is shown with a spring 110 pushing pawl 112 with its front teeth 114 engaging the spline or tooth profile 106. Second body 108 is shown engaged by anti-rotation pin 116 which in turn engages tab 118 to prevent its rotation. An outer tooth profile 101 is shown and is similar to the profile on sprocket 18 seen in FIG. 1.

Figure 6:
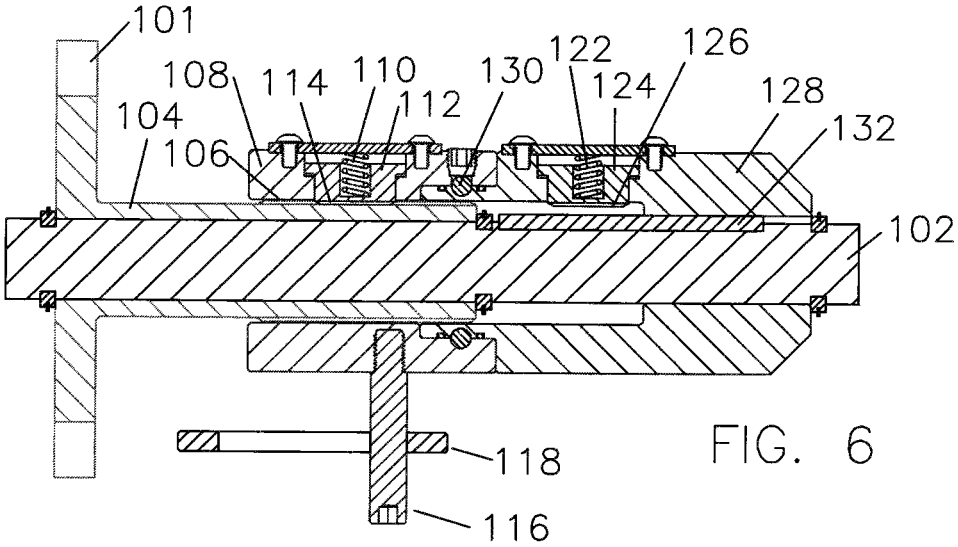
FIG. 6 is a half section of FIG. 5 taken along section lines "6-6" showing the clutch in the braking position.

Referring now to FIG. 6 which is taken along lines "6-6" of FIG. 5, it can be seen that the components spring 110, pawl 112, and teeth 114 are matched by spring 122, pawl 124, and teeth 126 which are mounted on second body 128 which is rotationally connected to first body 108 by ball bearings 130. Teeth 126 are not connected to first body 108, but second body 128 is connected to the main shaft 102 through key 132 so second body 128 will freely rotate as main shaft 102 rotates, but will not turn the spool. Sprocket profile 101 is part of output shaft 104 which is engaged by pawl 112 which is mounted on first body 108, which is in turn retrained by anti-rotation pin 116, which is in turn restrained by tab 118, so sprocket profile 101 is prevented from turning and acts as a brake to the spool.

Figure 7:
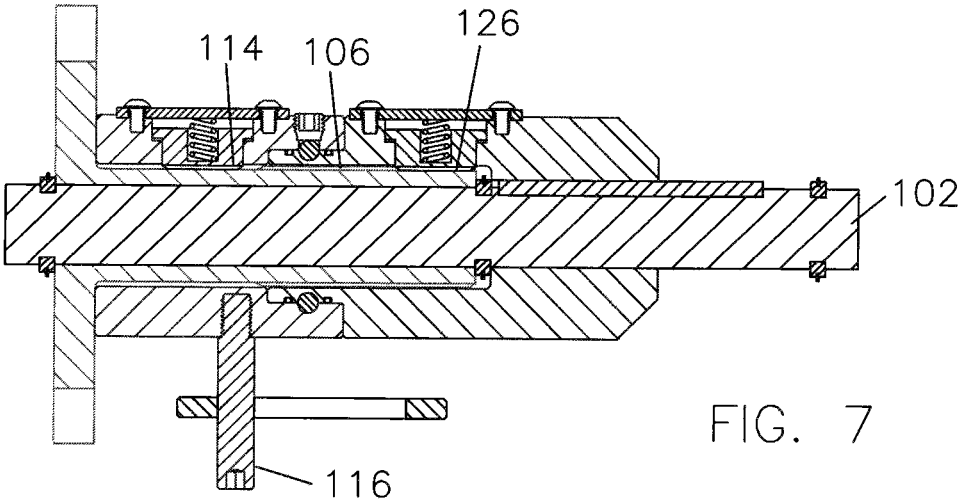
FIG. 7 is a half section of FIG. 5 taken along section lines "6-6" showing the clutch in the driving position.

Referring now to FIG. 7, the anti-rotation pin 116 is moved to the left position and teeth 126 are engaged with spline or tooth profile 106 and teeth 114 are disengaged. This releases the braking action from teeth 114 and allows the rotation of main shaft 102 to power the spool through teeth 126.

Figure 8:
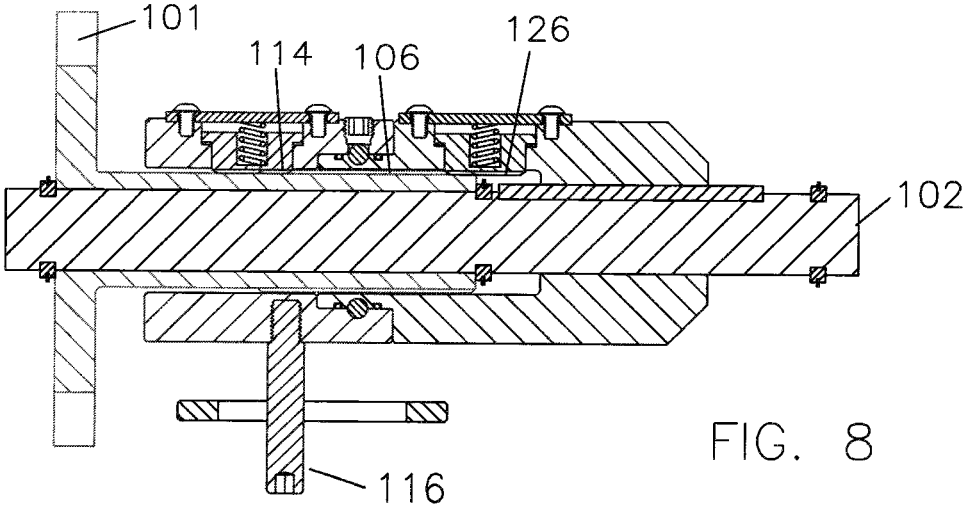
FIG. 8 is a half section of FIG. 5 taken along section lines "6-6" showing the clutch in an intermediate position engaging both the driving and the braking means.

Referring now to FIG. 8, anti-rotation pin 116 is shown in position intermediate to the positions as shown in FIG. 6 and FIG. 7 and in this position the teeth 114 and the teeth 126 are both engaged with the teeth 106. This means that at this time the spool (as powered through sprocket profile 101) is stationary and the main shaft is prevented from turning.

A somewhat different characteristic occurs in alternate clutch design 100 (FIG. 5) from clutch 10 (FIG. 1). On clutch 10, the clutch could not be shifted until the pins and slots were lined up. On alternate clutch design 100, the clutch can be shifted at any time irrespective of the rotational angle of the components. However, the clutch may not actually be engaged until there is a slight rotation of the spool. This exchanges the absolute knowledge of engagement with clutch 10 or the ease of engagement of alternate clutch design 100.

Figure 9:
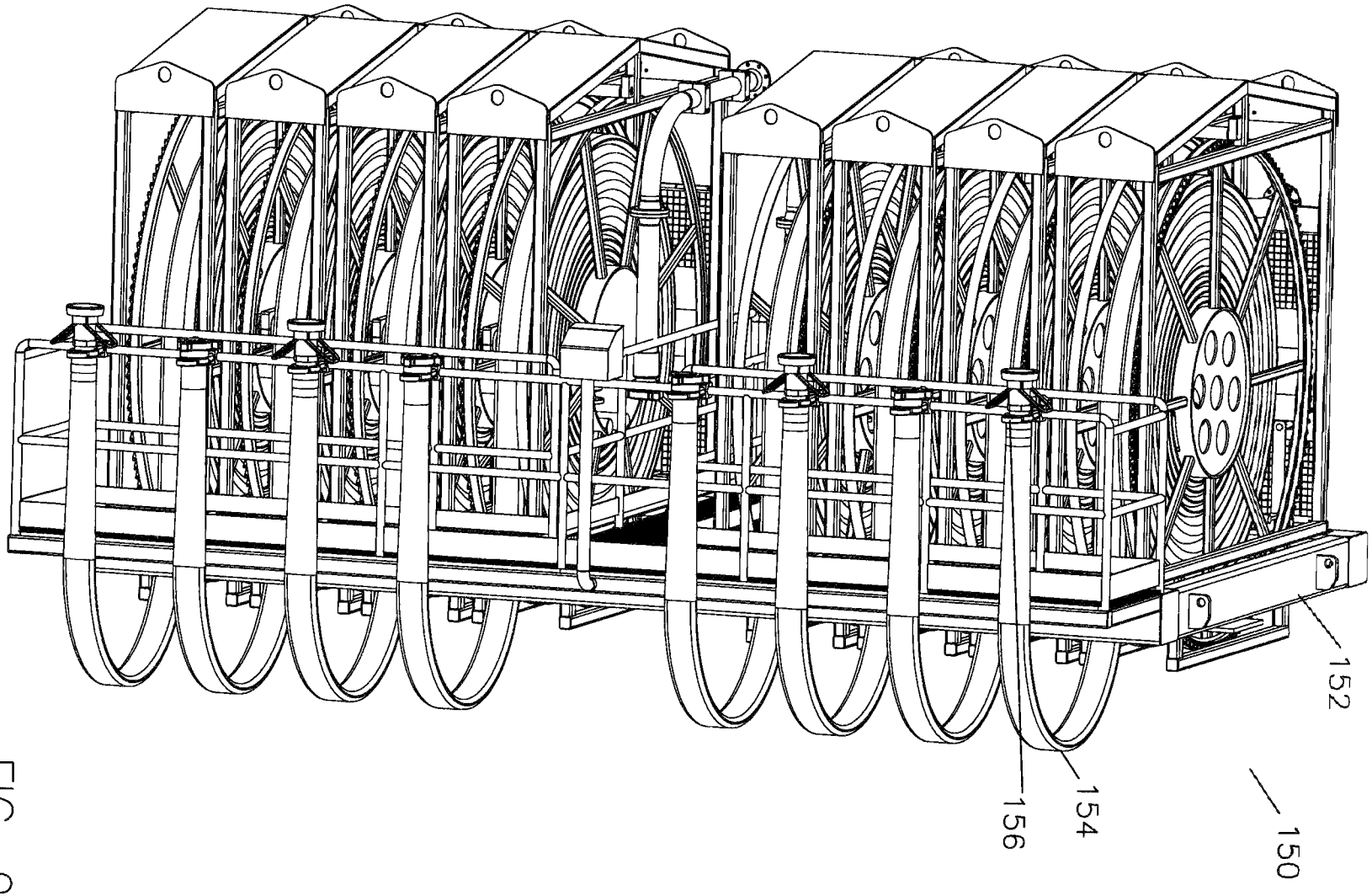
FIG. 9 is a perspective view of a group of 8 loading stations mounted on a common base as seen from out to sea.

Referring to FIG. 9, a group of 8 individual loading stations 150 are shown mounted on a common frame 152, each having a hose such as 154 with a connector 156 to be deployed to deliver it product to a vessel or port.

Figure 10:
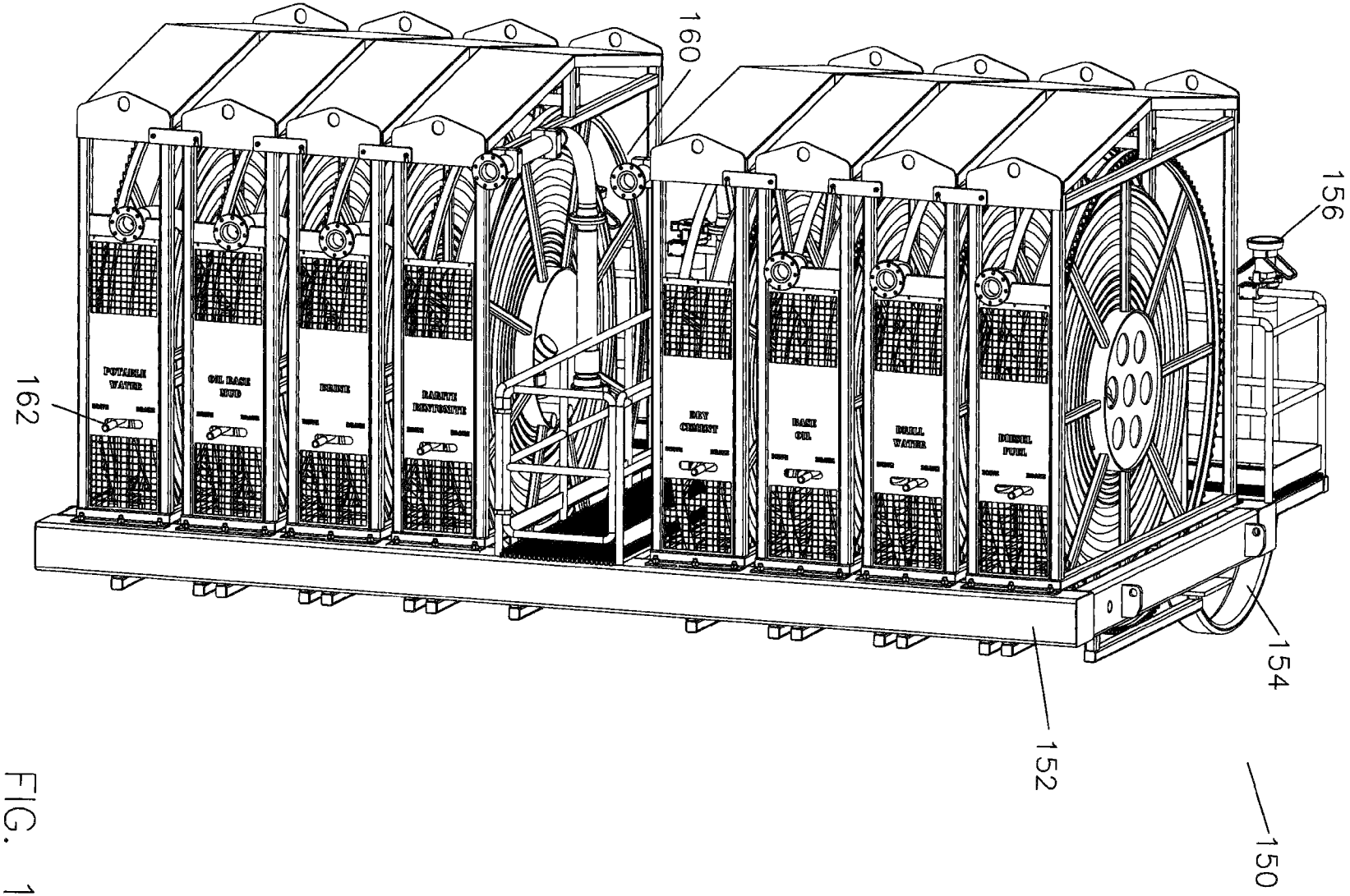
FIG. 10 is a perspective view of a group of 8 loading stations mounted on a common base as seen from the vessel or boat as a worker would see it.

Referring now to FIG. 10, the opposite side of the group of loading stations 150 is shown. Each individual loading station has a fitting such as 160 for connection of piping to administer the fluid or powder to be received or delivered. Handle 162 will operate the clutch of this invention.

Figure 11:
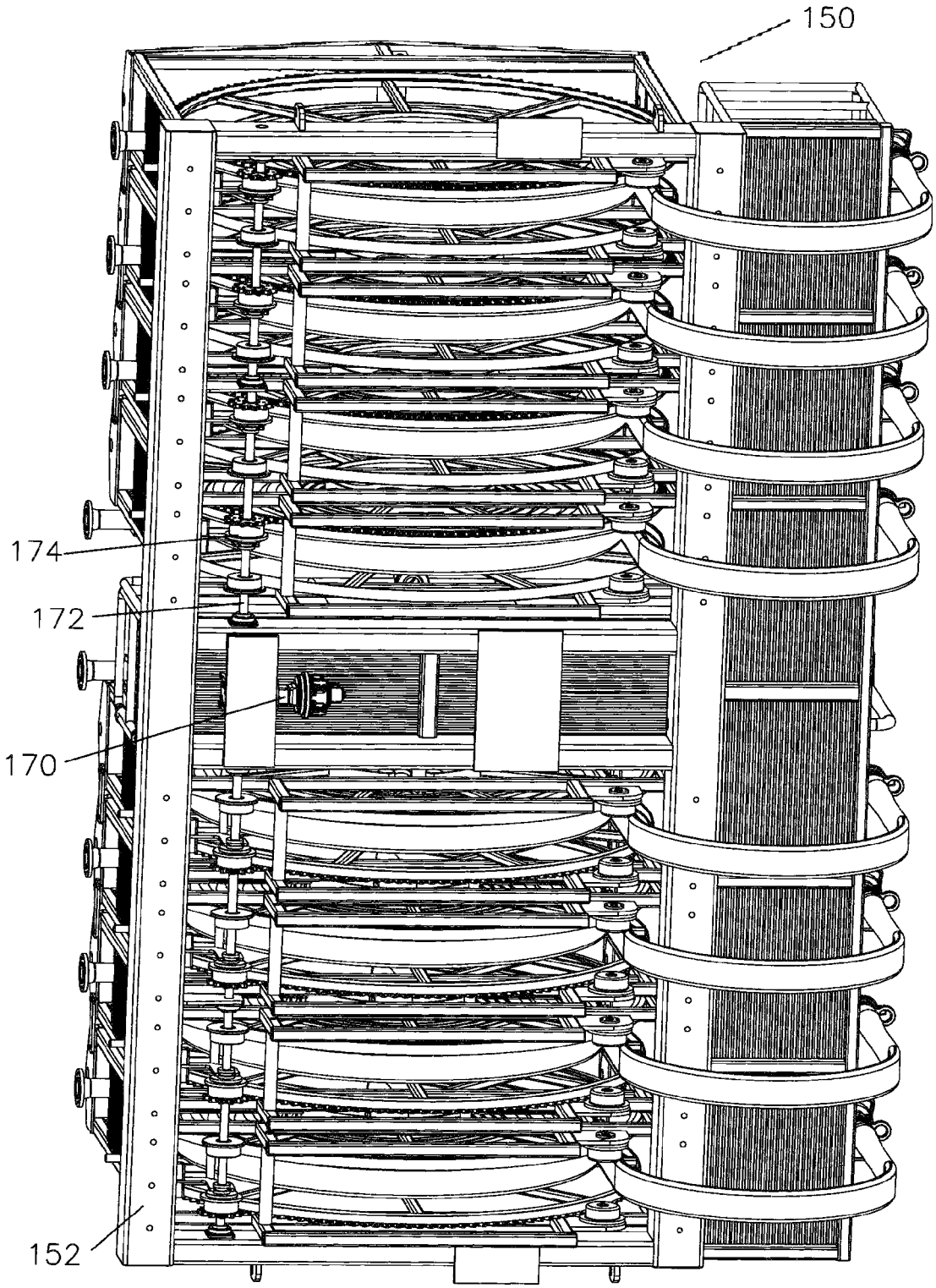
FIG. 11 is a perspective view of a group of 8 loading stations mounted on a common base as seen from the bottom.

Referring now to FIG. 11, a bottom view of the group of loading stations 150 showing a single motor 170 to drive the interconnected shafts 172 with the various clutches 174. The single motor 170 provides the power to operate all of the loading stations simultaneously or one at a time.

Figure 12:
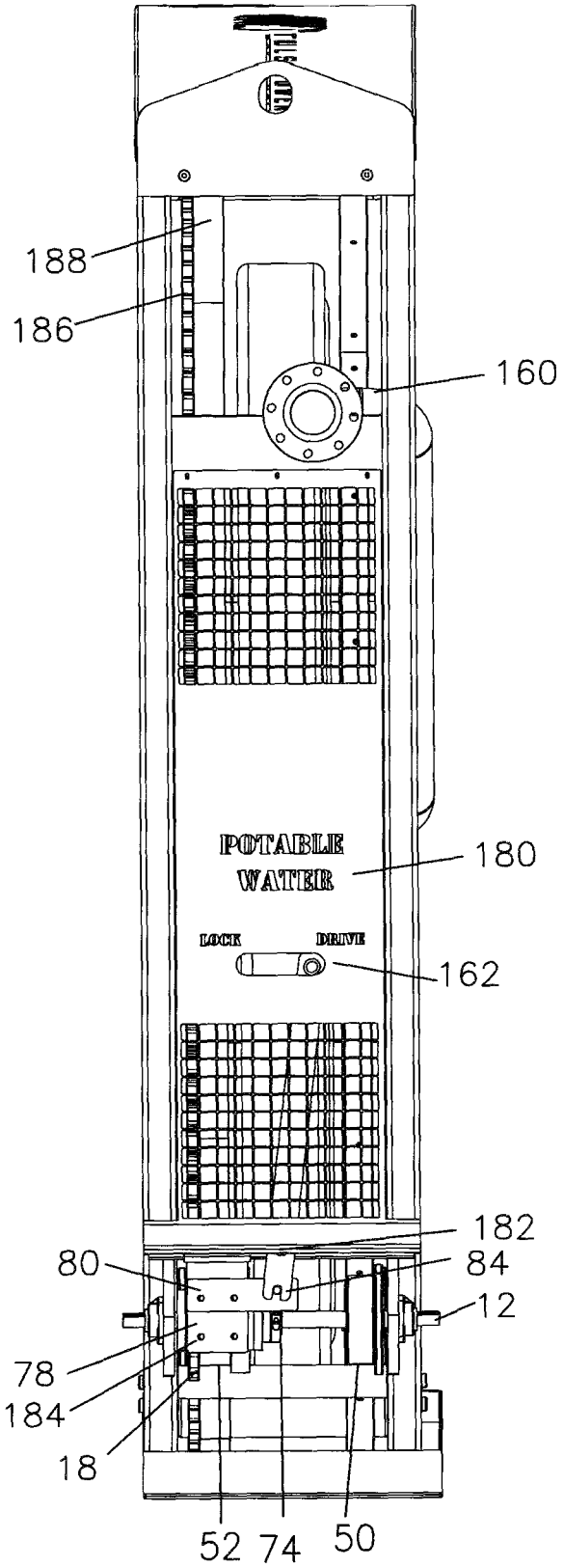
FIG. 12 is a view of a single loading station as would be seen from a worker on the vessel or dock.

Referring now to FIG. 12, the end of a single loading stations is shown similarly to the view of FIG. 10. A fitting 160 is shown for administering the powder or fluid to the hose, which is deployed on the opposite side of the loading station. In the case of this particular loading station, the product to be handled is potable water as can be seen on the label 180. The handle 162 is presently in the position to shift the clutch to the drive position rather than the lock or braking position. Pivot 182 is provided such that the movement of the handle 162 will shift the clutch at 184. Sprocket profile 18 on the clutch engages sprocket profile 186 on the spool 188 to drive the spool.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

SEQUENCE LISTING

N/A

That which is claimed is:

1. The method of mechanically controlling a rotation in either direction of a driven spool for offshore vessels loading stations comprising the steps of:

providing said spool on an offshore vessel or dock wherein said spool is adapted to be used with a hose of about a three inch to about six-inch diameter, said hose capable of floating and passing liquids and dry powders, and said spool is adapted to raise and lower said hose without slipping;

providing a motor to drive said spool for said raising and said lowering of said hose;

providing a clutch in communication with said motor and said spool and said clutch is constantly engaged with said spool and said motor;

providing a first position in which a first motive force is applied to said spool through said clutch, providing a second position in which a second motive force is applied to said spool through said clutch, providing a third position intermediate to said first position and said second position in which both said first motive force and said second motive forces are applied to said spool through said clutch, such that there during a movement between said first position, said third position, and said second position there is no time at which at least one of said first motive force or said second motive force is not applied to said spool, said clutch remains in constant engagement with said spool and said clutch is never in neutral; and controlling said rotation in either direction of said driven spool for offshore vessels loading stations.

2. The method of claim 1 further comprising that said first motive force is a rotational force.

3. The method of claim 1 further comprising that said second motive force is a braking force.

4. The method of claim 1 further comprising that said first motive force is a rotational force and said second motive force is a braking force and said spool will not rotate in said second position and said third position.

5. The method of claim 1 further that said clutch is comprised of providing a multiplicity of pins which engage a multiplicity of slots.

6. The method of claim 1 further that said clutch is comprised of providing an external gear with an internal gear.

7. The method of claim 1 further that said clutch is comprised of providing an external spline with an internal spline.

* * * * *